US010589441B2

(12) United States Patent
Hirmke

(10) Patent No.: US 10,589,441 B2
(45) Date of Patent: Mar. 17, 2020

(54) METHOD OF PRODUCING A LAMINATED WOOD PRODUCT, AND LAMINATED WOOD PRODUCTS

(71) Applicant: STORA ENSO OYJ, Helsinki (FI)

(72) Inventor: Markus Hirmke, Rossatz-Arnsdorf (AT)

(73) Assignee: Stora Enso OYJ, Helsinki (FI)

( * ) Notice: Subject to any disclaimer, the term of this patent is extended or adjusted under 35 U.S.C. 154(b) by 165 days.

(21) Appl. No.: 15/579,635

(22) PCT Filed: Jun. 16, 2016

(86) PCT No.: PCT/IB2016/053566
§ 371 (c)(1),
(2) Date: Dec. 5, 2017

(87) PCT Pub. No.: WO2016/203416
PCT Pub. Date: Dec. 22, 2016

(65) Prior Publication Data

US 2018/0154547 A1 Jun. 7, 2018

(30) Foreign Application Priority Data

Jun. 18, 2015 (SE) ..... 1550853

(51) Int. Cl.
*B27M 3/00* (2006.01)
*E04C 3/12* (2006.01)
(Continued)

(52) U.S. Cl.
CPC ..... *B27M 3/0053* (2013.01); *B27M 3/006* (2013.01); *B27M 3/0026* (2013.01);
(Continued)

(58) Field of Classification Search
CPC ..... B27B 1/00; B27B 1/005; B27M 3/0026; B27M 3/006; B27M 3/0053
See application file for complete search history.

(56) References Cited

U.S. PATENT DOCUMENTS 1,369,743 A 2/1921 Hood et al.
1,883,616 A 10/1932 Williams
(Continued)

FOREIGN PATENT DOCUMENTS

EP 0650811 A1 5/1999
GB 2465148 A 5/2010
(Continued)

OTHER PUBLICATIONS

International Search Report for PCT/IB2016/053566, dated Sep. 20, 2016.
(Continued)

*Primary Examiner* — Matthew Katcoff
(74) *Attorney, Agent, or Firm* — Greer, Burns & Crain Ltd.

(57) ABSTRACT

The present disclosure provides a method of forming a laminated wood product, which is adapted for receiving a load in a direction perpendicular to a principal fiber direction of the wood. The method comprises cutting a log (2) along the principal fiber direction of the log, into a plurality of wood lamellae (20*a*, 20*b*), such that the wood lamellae are formed as radial sections of the log, forming the wood lamellae (20*a*, 20*b*) to provide each wood lamella with a trapezoidal cross section, whereby the wood lamellae present a respective planar major base surface (bs1) that is formed at a radially outer part of the log (2) and a respective planar minor base surface (bs2) that is formed at a radially inner part of the log (2), arranging the lamellae (20*a*, 20*b*) as at least one layer in which planar major base surfaces (bs1) of immediately adjacent lamellae (20*a*, 20*b*) face
(Continued)

opposite directions, and gluing together the lamellae (20*a,* 20*b*) side surface to side surface (ss1, ss2) such that a wood billet is formed. The method further comprises arranging the wood lamellae (20*a, b*) such that the major base surfaces (bs1) of immediately adjacent wood lamellae taper in opposite directions, and the gluing comprises wet gluing.

18 Claims, 10 Drawing Sheets

(51) Int. Cl.
*E04C 2/12* (2006.01)
*B27B 1/00* (2006.01)

(52) U.S. Cl.
CPC ..... *E04C 2/12* (2013.01); *E04C 3/122* (2013.01); *B27B 1/005* (2013.01)

(56) References Cited

U.S. PATENT DOCUMENTS

| | | | | |
|---|---|---|---|---|
| 3,897,581 | A * | 7/1975 | Nakatsuka | C08G 18/10 428/44 |
| 3,961,654 | A | 6/1976 | Hasenwinkle | |
| 3,977,449 | A | 8/1976 | Sadashige | |
| 4,111,247 | A | 9/1978 | Hasenwinkle | |
| 4,122,878 | A * | 10/1978 | Kohn | B27B 1/005 144/350 |
| 4,476,663 | A | 10/1984 | Bikales | |
| 5,560,409 | A * | 10/1996 | Knorr | B27B 1/005 144/248.7 |
| 5,674,338 | A | 10/1997 | Parker et al. | |
| 2006/0162851 | A1 | 7/2006 | Engel et al. | |
| 2013/0183477 | A1 | 7/2013 | Leitinger et al. | |

FOREIGN PATENT DOCUMENTS

| | | | |
|---|---|---|---|
| JP | S49125503 | A | 12/1974 |
| WO | 9216339 | A1 | 10/1992 |
| WO | 9613361 | A1 | 5/1996 |
| WO | 9800270 | | 1/1998 |
| WO | 2013033736 | A2 | 3/2013 |

OTHER PUBLICATIONS

Peterson. H.et al. "Högre värdeutbyte genom våt- och torrlimning av sågade sidobräder till egenskapsoptimerade träprodukter för byggmarknaden," Växjö University, No. 53, 2009.

* cited by examiner

METHOD OF PRODUCING A LAMINATED WOOD PRODUCT, AND LAMINATED WOOD PRODUCTS

This application is a U.S. National Stage under 35 U.S.C. § 371 of International Application No. PCT/IB2016/053566, filed Jun. 16, 2016, which claims priority to Swedish patent application No. 1550853-4, filed Jun. 18, 2015.

TECHNICAL FIELD

The present disclosure relates to a structural member, which may be used as a beam, a joist, a stud, a pillar or the like. The disclosure also relates to a method of producing the structural member.

BACKGROUND

Currently, glue-laminated beams ("gluelam") in Europe are mostly produced according to DIN 1052:2008 (German standard) or DIN EN 14080: 2013-09 (harmonized European standard). The beams are built up with visually graded or machine graded boards, which are produced and kiln-dried in sawmills in the traditional way.

The gluelam producer takes these boards as raw material, grades them and produces the required lamellae by cutting out defects (e.g. knots) and finger-jointing the pieces together. After the finger-jointed lamellae have been planed, glue is applied and the beam is formed by gluing the lamellae together. The final steps may comprise planing the beam, removing optical defects, packaging and loading it.

Hence, traditionally, timber is sawn into planks or lamellae according to the scheme depicted in FIG. 1 of U.S. Pat. No. 5,816,015, which discloses alternative methods of forming wood beams by laminating together a plurality of planks or lamellae.

EP1277552A2 discloses a similar method of forming a wood beam by cutting a round piece of timber into a plurality of strips having a trapezoidal cross section and laminating together the pieces thus formed into a beam.

U.S. Pat. No. 4,122,878 discloses a method of converting balsa wood of relatively small diameter into panels.

There is still a need to provide improved use of the timber raw material, as well as a need for beams having improved strength and/or reduced variation in strength between different beams.

SUMMARY

It is a general object of the present invention to provide an improved structural member, such as a beam, a joist, a stud, a pillar or the like. A particular object includes the provision of a structural member which makes better use of existing raw materials and which is stronger. Further objects include the provision of improved control of the production process of structural members, such that properties of resulting members will present less variation.

The invention is defined by the appended independent claims, with embodiments being set forth in the dependent claims and in the following description and drawings.

According to a first aspect, there is provided a method of forming a laminated wood product, which is adapted for receiving a load in a direction perpendicular to a principal fiber direction of the wood, the method comprising cutting a log along the principal fiber direction of the log, into a plurality of wood lamellae, such that the wood lamellae are formed as radial sections of the log. The method further comprises forming the wood lamellae to provide each wood lamella with a trapezoidal cross section, whereby the wood lamellae present a respective planar major base surface that is formed at a radially outer part of the log and a respective planar minor base surface that is formed at a radially inner part of the log, arranging the lamellae as at least one layer in which planar major base surfaces of immediately adjacent lamellae face opposite directions, and gluing together the lamellae side surface to side surface such that a wood billet is formed. The method further comprises arranging the wood lamellae such that the major base surfaces of immediately adjacent wood lamellae taper in opposite directions. The gluing comprises wet gluing.

The term "major base surface" is defined as the greater one of the two base surfaces of a body having a trapezoidal cross section. Likewise, the "minor base surface" is defined as the smaller one of the base surfaces of a body having trapezoidal cross section.

The term "wet gluing" is defined as gluing at a moisture content of the wood lamellae greater than 25% by dry mass, preferably greater than 30% by dry mass.

The moisture content is calculated in relation to the mass of the dry wood, i.e. moisture content=(mass of wet wood−mass of dry wood)/(mass of dry wood).

A glue that is suitable for wet gluing may be a polyurethane based glue.

The forming may comprise a first forming step, in which the major base surfaces are formed along the outermost part of the log, preferably along a direction which is substantially parallel with the outermost surface of the log.

By "substantially parallel" is understood that there is an angular deviation of less than 3°, preferably less than 2° or less than 1°.

The minor base surfaces may be formed along a direction which, as seen in a plane containing the pith, presents an angle relative to a pith direction, that is greater than an angle between the major base surface and the outermost surface of the log.

The forming may comprise a second forming step, in which the minor base surfaces are formed by removal of material at a portion of the respective lamella, which is closest to the pith, and wherein more of a height of the trapezoidal cross section is removed when forming the minor base surface than when forming the major base surface.

The wood lamellae may be formed such that a distance, along a surface normal of the base surfaces, between the base surfaces, may be at least 50% of a radius of the log, preferably at least 60%, at least 70% or at least 80% of the radius of the log.

The cutting may comprise cutting the wood lamellae to an apex angle of less than 45°, preferably less than or equal to 40°, less than or equal to 36° or less than or equal to 30°.

Specifically preferred angles may be 45°, 40°, 36°, 30°, 24°, or 22.5°.

The method may further comprise a step wherein the wood lamellae are subjected to surface drying prior to gluing the wood lamellae together.

The surface drying may affect the moisture content of the wood lamellae by less than 5%, preferably by less than 1%, most preferably by less than 0.5%.

The method as claimed in any one of the preceding claims, wherein arranging the lamellae comprises arranging the lamellae as a single layer, with base surfaces exposed.

The arranging may comprise turning every second lamella 180° about its longitudinal axis and 180° about an axis which is perpendicular to the longitudinal axis and perpendicular to its base surfaces.

The method may further comprise cutting the billet along a plane which is parallel to the principal fiber direction, and preferably perpendicular to the base surfaces, thus forming a plurality of planks.

As an alternative, or supplement, the method may further comprise cutting the billet along a plane which is parallel to the principal fiber direction, and preferably parallel with the base surfaces, thus forming a plurality of sheets.

The cutting may be performed such that each plank comprises portions of at least two glued-together lamellae. In particular embodiments, each plank may comprise portions of 2, 3, 4, 5, 6 or more lamellae.

The method may further comprise subjecting the planks to a drying step, such as a kiln drying.

The method may further comprise joining together at least two of the dried planks in an end-to-end manner, e.g. through finger-jointing, such that a longer plank is formed.

Such finger-jointing may be performed by a dry-gluing method.

The method may further comprise laminating together at least two dried planks and/or joined-together planks by gluing base surface to base surface.

According to a second aspect, there is provided a laminated wood product, adapted for receiving a load in a direction perpendicular to a principal fiber direction of the wood. The wood product comprises at least two glued-together wood lamellae, which are formed as radial sections of a log, each having a lamella cross section which is parallel with a cross section of the wood product and a longitudinal direction which is parallel with a longitudinal direction of the wood product and with a principal fiber direction of the wood lamellae. The lamellae present cross sections which are trapezoidal and present a respective planar major base surface that is formed at a radially outer part of the log and a respective minor base surface that is formed at a radially inner part of the log. The lamellae are arranged as at least one layer in which major base surfaces of immediately adjacent lamellae face opposite directions. The major base surfaces of immediately adjacent wood lamellae taper in opposite directions. The wood lamellae are glued together by a glue suitable for wet gluing.

Such a laminated wood product may have a moisture content of less than 25% by dry mass, preferably less than 15% or less than 10%.

The lamellae may be arranged as a single layer, with the base surfaces exposed.

The lamellae may be arranged as at least two layers, which are glued together base surface to base surface.

Such at least two layers may be glued together by wet gluing or dry gluing.

The wood lamellae may present a height, along a surface normal of the base surfaces, between the base surfaces, which may be at least 50% of a radius of the log, preferably at least 60%, at least 70% or at least 80% of the radius of the log.

According to a third aspect, there is provided an elongate wood member comprising at least two laminated wood products as described above, which are joined together end-to-end, e.g. by a finger joint connection.

It is recognized that an area of the cross section may be smaller than an area of any adjoining side perpendicular to the cross section.

The wood product may be formed of a plurality of lamellae.

However, the wood product may be formed by two or more lamellae, at least one of which presents an incomplete trapezoidal cross sections due to sawing in a direction perpendicular to the cross section.

In the wood product or wood plank, at least 50%, preferably at least 75% or at least 95%, of the wood lamellae may present a modulus of rupture greater than 6 MPa$\times 10^3$, preferably greater than 10 MPa$\times 10^3$ or greater than 15 MPa$\times 10^3$.

In the wood product or wood plank, at least 50%, preferably at least 75% or at least 95%, of the wood lamellae may present a density of at least 200 kg/m$^3$, preferably at least 400 kg/m$^3$ or at least 600 kg/m$^3$, said density taken at 15% RH, 25° C. (about 5% moisture ratio).

It is contemplated that in most practical applications, there will be a single species of wood, and thus all of the wood will exhibit the modulus of rupture property and/or the density mentioned above.

DETAILED DESCRIPTION

Figure 1A:
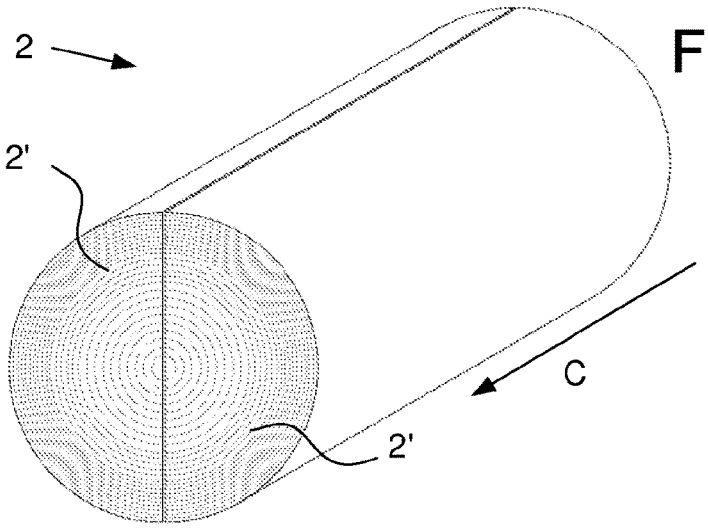
FIGS. 1*a*-1*k* schematically illustrate a method of making a laminated wood product.

FIG. 1*a* schematically illustrates a log 2, which has been cut longitudinally into two halves 2'. The log 2 may have been debarked prior to this cutting. The cutting may be performed by any type of cutting device, such as, but not limited to, a saw, e.g. a circular saw or a band saw.

Figure 1B:
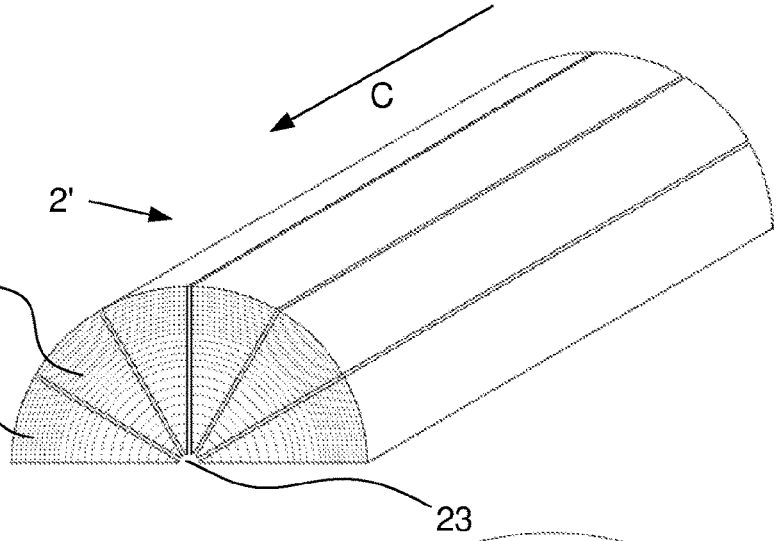

FIG. 1*b* schematically illustrates a log half 2' after it has provided with a longitudinally extending groove 23 along its pith and cut longitudinally into six radial sections 2"*a*, 2"*b*, as will be further described with reference to FIGS. 2*a*-2*b*.

Figure 1C:
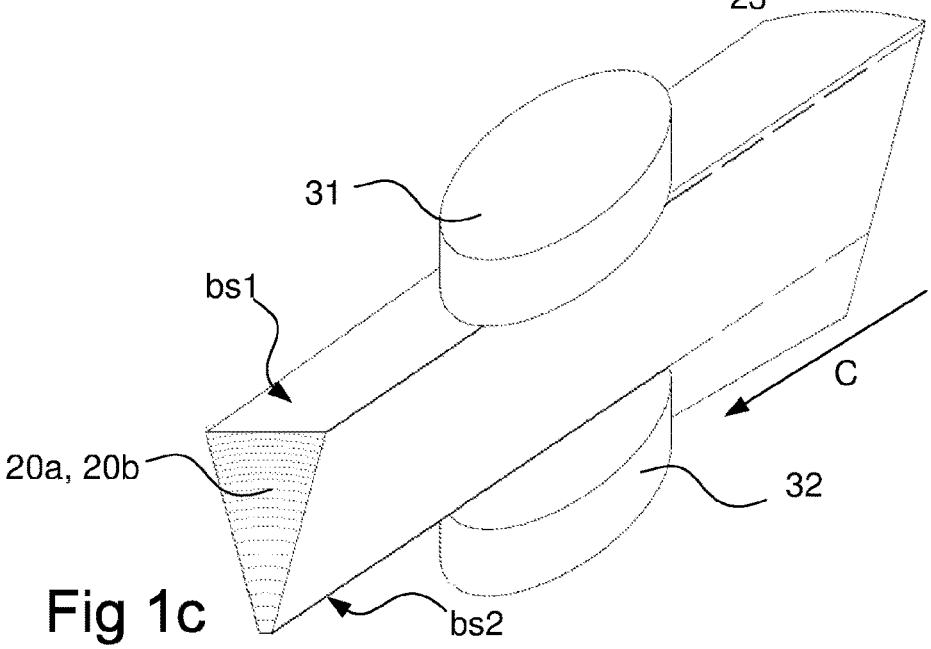

FIG. 1*c* schematically illustrates processing of one of the radial sections 2"*a*, 2"*b*, into a lamella 20*a*, 20*b*. The lamella 20*a*, 20*b* is subjected to forming of base surfaces bs1, bs2, to form a lamella 20*a*, 20*b*, which will present a trapezoidal cross section.

The base surfaces bs1, bs2 thus formed comprise a major base surface bs1, which is formed by tool 31 closest to the bark of the log and along the bark side. The base surfaces further comprise a minor base surface bs2, which is formed close to the pith and parallel with the major base surface bs1 by tool 32.

The tools 31, 32 may be any type of tool capable of forming a planar surface, including but not limited to milling cutters, circular saw blades or band saw blades.

The first tool 31, which forms the major base surface bs1, is arranged to use the bark side as reference, such that the major base side bs1 is formed along a direction parallel with the bark side.

The second tool 32, which forms the minor base surface bs2, is arranged to use the major base surface and/or the bark side as a reference, such that the minor base surface bs2 is formed along a direction parallel with the major surface and/or the bark side.

The cross section of the lamellae 20*a*, 20*b* is trapezoidal having a constant height. With the major base surface bs1 being formed substantially parallel with the bark, and with the log presenting a frusto-conical shape, it is recognized that the major base surface bs1 will taper along the central direction of the log C. That is, the log will taper in a direction towards the top of the tree from which it was formed. This direction is also parallel with the principal fiber direction of the log and of the wood lamellae.

Moreover, the minor base surface bs2 will also taper along the central direction C of the log.

The fact that the radius of the log would also diminish towards the top of the tree from which it was formed, implies that while the amount of material removed at the bark side, by tool 31, in the forming of the major base sides bs1 will be substantially constant along the length of the lamella 20*a*, 20*b*, as seen in the radial direction.

However, the amount of material removed at the pith side, by tool 32, will diminish towards as seen in the direction towards the top of the tree from which the lamella 20*a*, 20*b* was formed.

Figure 1D:
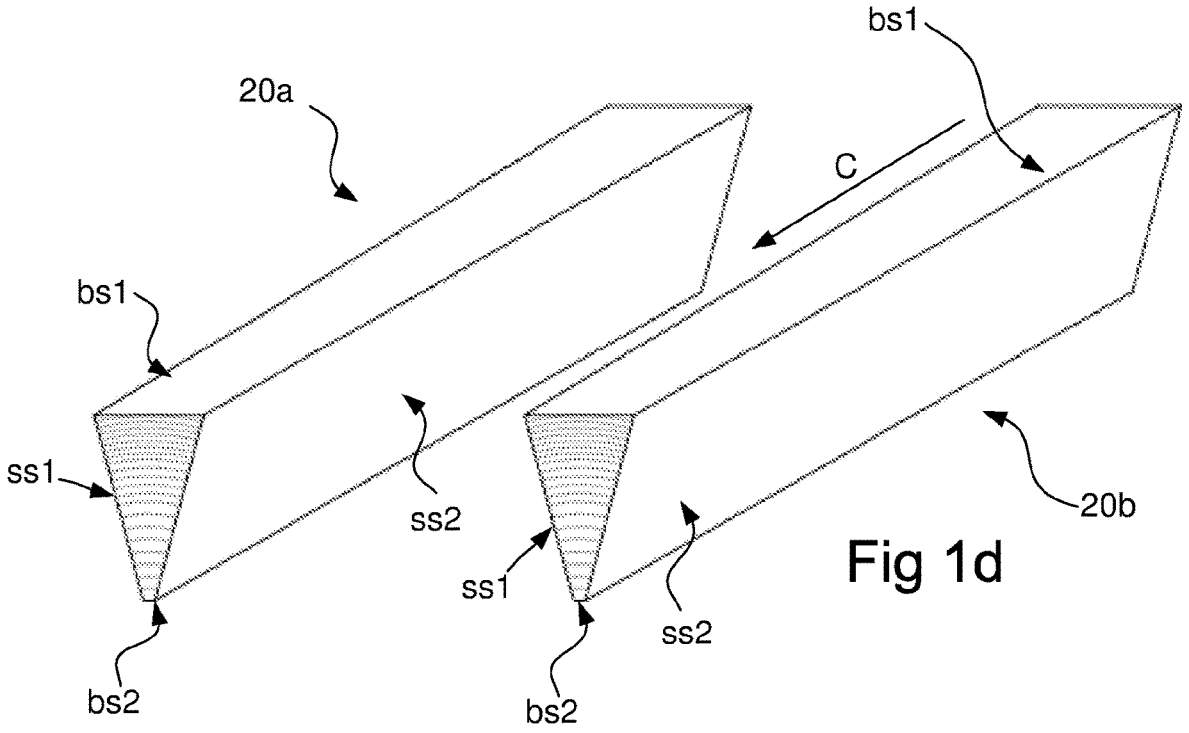

Referring to FIG. 1*d*, after the lamellae 20*a*, 20*b* have been formed, each lamella will have a major and a minor base surface bs1, bs2 and a pair of side surfaces ss1, ss2, which will be identical.

Figure 1E:
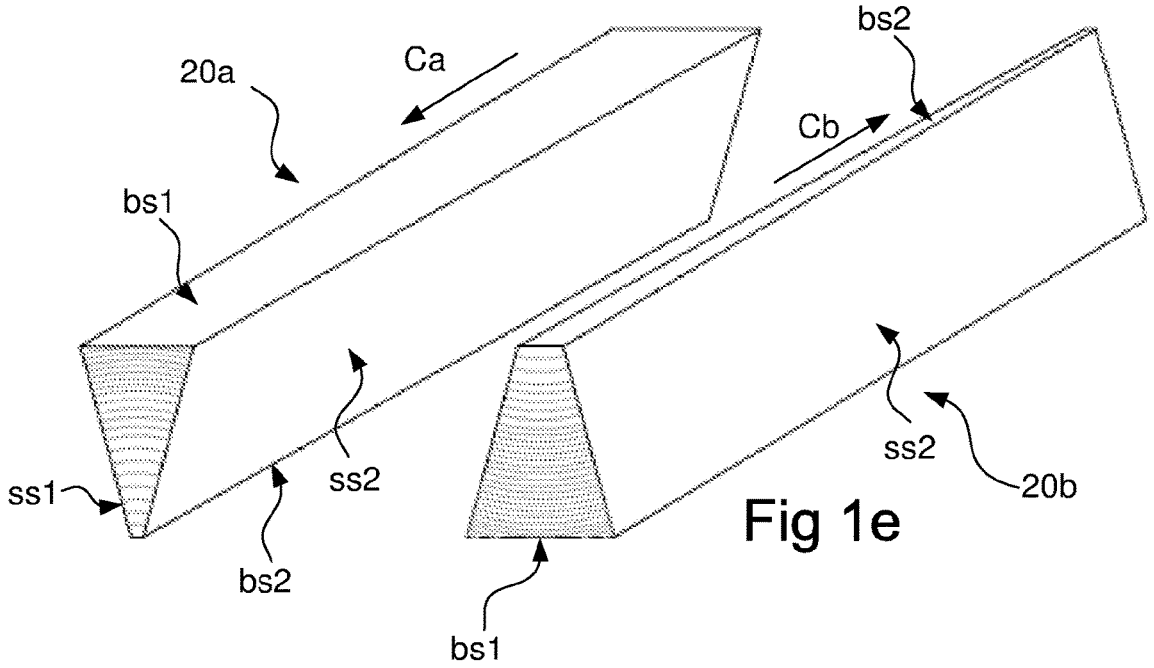

Referring to FIG. 1*e*, every second lamella 20*b* will now be turned or flipped about 180° about its longitudinal axis and about 180° about an axis perpendicular to the longitudinal axis and perpendicular to the major base surface bs1, such that the lamellae will become positioned as illustrated in FIG. 1*e*. That is, the directions of taper Ca and Cb will extend in opposite directions.

At this point, the base surfaces of every pair of adjacent wood lamellae 20*a*, 20*b* will taper towards substantially opposite directions. Moreover, major base surfaces bs1 of every pair of adjacent wood lamellae will face substantially opposite directions, i.e. one upwards in FIG. 1*e* and the other one downwards in FIG. 1*e*.

At this point, the wood may still be "wet", that is, its moisture content may be more than 25% by dry mass, preferably more than 30%. Hence, the wood has not been subjected to any accelerated or intentional drying, such as kiln drying.

The lamellae may then be wet glued together side surface to side surface. Such wet gluing may be made without the cut surface, i.e. the side surfaces, being subjected to any further surface processing other than cleaning and removal of free water from the cut surface.

When wet gluing, it is recommended to reduce the amount of free water on the wood surface to a minimum. Hence a brief surface drying step, basically having no effect except for on the very surface, may be performed, e.g. by means of a fan.

Figure 1F:
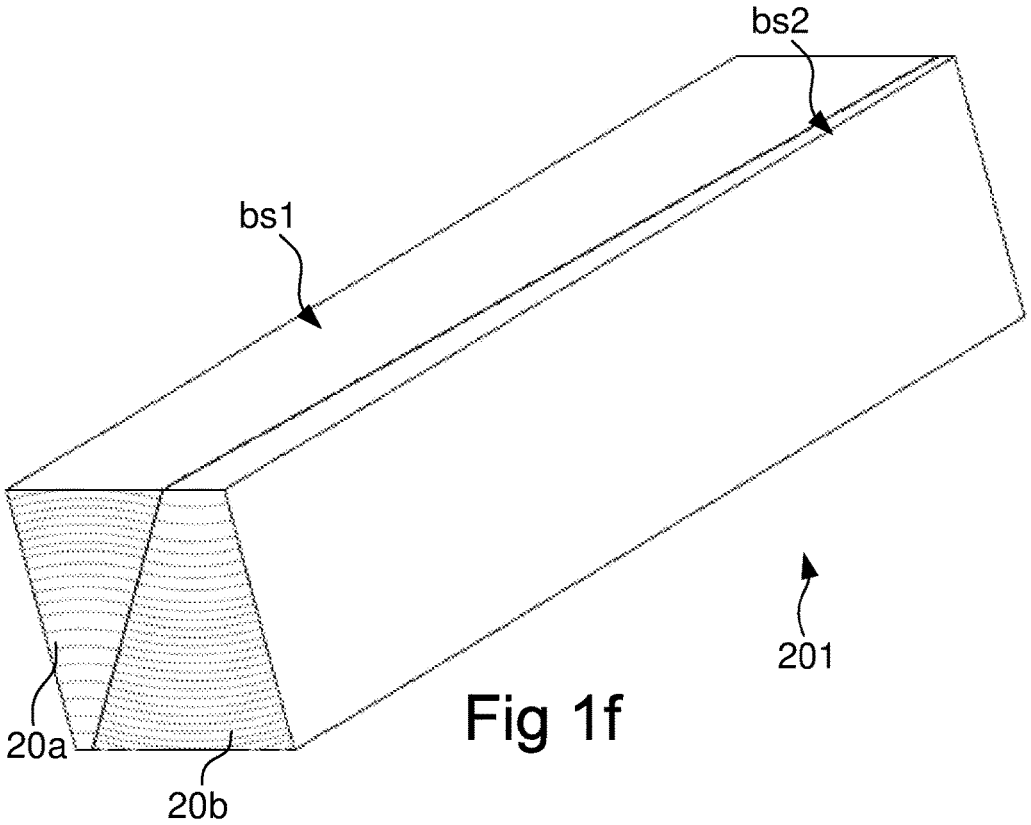

FIG. 1*f* schematically illustrates the two lamellae 20*a*, 20*b* when arranged adjacent each other, side surface ss1 to side surface ss2 and with base surfaces bs1, bs2 of the pair of thus adjacent lamellae 20*a*, 20*b* tapering in opposite directions.

Figure 1G:
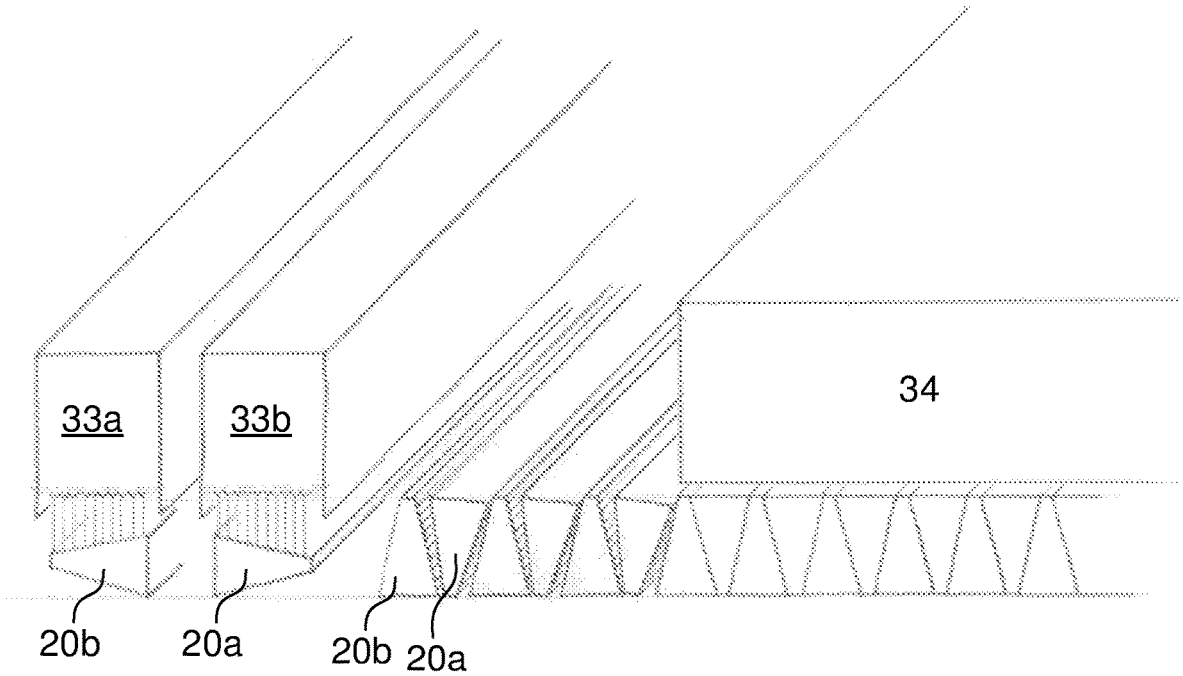

Referring to FIG. 1*g*, there is illustrated a pair of glue applicators 33*a*, 33*b*, which apply glue to side surfaces of lamellae 20*a*, 20*b*, respectively. A single, or even more, glue applicators may be used.

The lamellae are then arranged as illustrated in FIG. 1*g*, i.e. with the base surfaces bs1, bs2 of every pair of adjacent wood lamellae 20*a*, 20*b* tapering towards substantially opposite directions and major base surfaces bs1 of every pair of adjacent wood lamellae facing substantially opposite directions.

The glue used is a glue adapted for wet gluing wood, such as a water activated glue. One example of such glue is a polyurethane (PU) based glue.

The lamellae 20*a*, 20*b* will be subjected to a pressing tool 34 pressing the lamellae 20*a*, 20*b* together in directions perpendicular to the base surfaces 20*a*, 20*b* and/or parallel with base surfaces 20*a*, 20*b* and perpendicular to longitudinal axes C.

FIGS. 1*h*-1*k* schematically illustrate a first way of processing the billet 200.

Figure 1H:
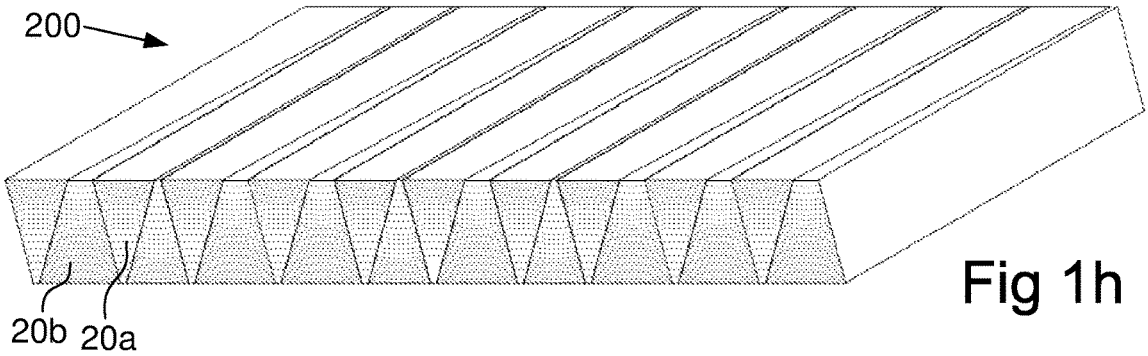

As illustrated in FIG. 1*h*, after the gluing process, an intermediate wood product, here referred to as a "billet" 200 is provided, made up of wood lamellae 20*a*, 20*b* glued together first side surface ss1 to first side surface ss1 and second side surface ss2 to second side surface ss2.

In the illustrated example, the billet 200 consists of a single layer of lamellae 20*a*, 20*b*, which are arranged side surface to side surface and with major base surfaces bs1 of immediately adjacent lamellae facing opposite directions and with base surfaces bs1, bs2 of immediately adjacent lamellae tapering in width in opposite directions.

Figure 1I:
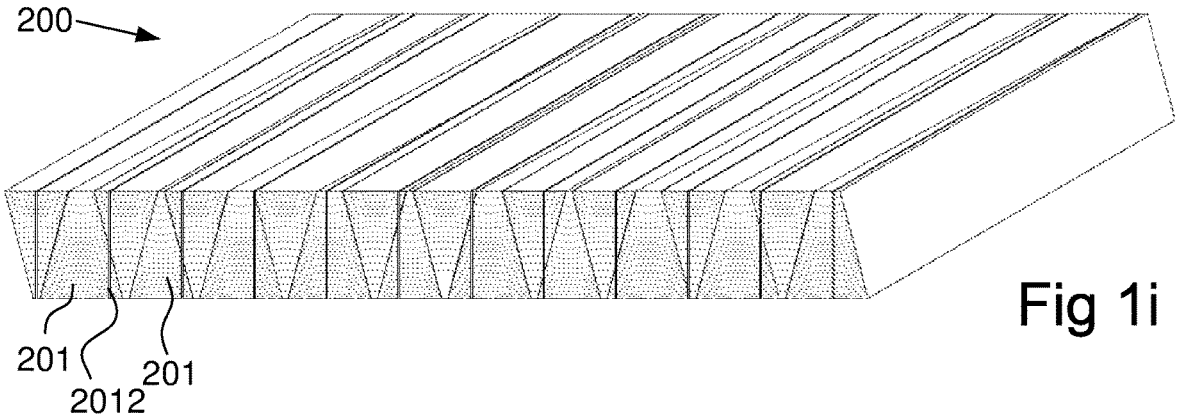

Referring to FIG. 1*i*, the billet 200 may be divided by cuts 2012 into a plurality of wood pieces 201 having substantially rectangular or square cross section and being of desired dimensions. These cuts 2012 may extend in planes that are perpendicular to the base surfaces and parallel with the principal fiber direction C of the lamellae 20*a*, 20*b*.

Each wood piece 201 will consist of parts of at least two lamellae 20*a*, 20*b*, frequently of three or more lamellae, which are arranged such that base surfaces bs1, bs2 every pair of adjacent wood lamellae 20*a*, 20*b* taper towards substantially opposite directions and major base surfaces bs1 of every pair of adjacent wood lamellae face substantially opposite directions. At least one of the wood lamellae 20*a*, 20*b* may present an incomplete trapezoidal cross section. The planks 201 may have a width corresponding to 1-3, preferably 1-2 major base surfaces of the lamellae 20*a*, 20*b* it is made up of. Moreover, the planks may have a thickness which is more than 50% of the radius of the log from which the lamellae were formed, preferably more than 75% of such radius, more than 80% of such radius, more than 85% of such radius or even more than 90% of such radius.

Figure 1J:
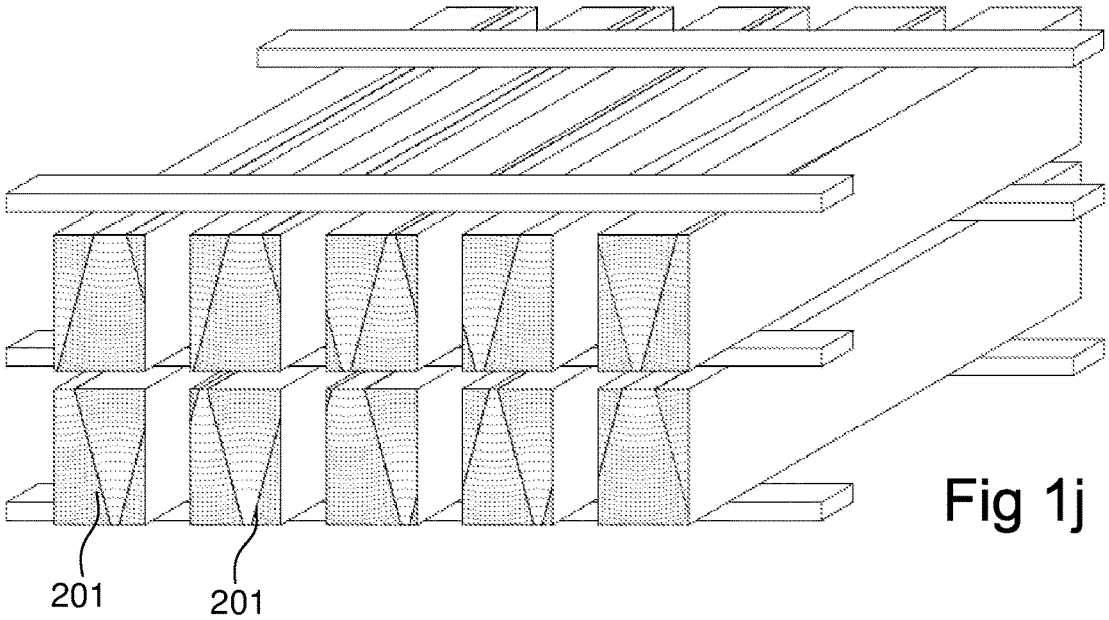

Referring to FIG. 1*j*, the wood pieces 201 may then be subjected to an accelerated drying, such as kiln drying, so as to reduce their moisture content to less than 20% by dry mass, preferably less than 15% by dry mass or less than 10% by dry mass.

Figure 1K:
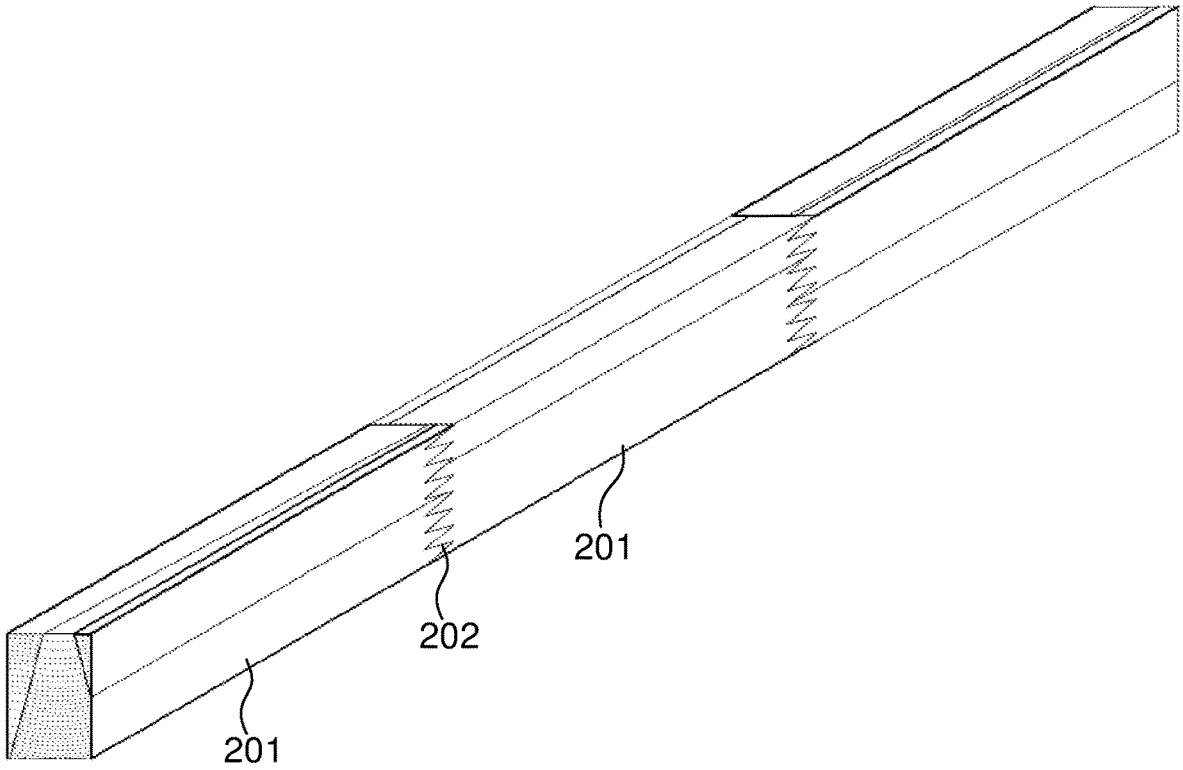

Referring to FIG. 1*k*, a pair, or more of the dried wood pieces 201 may be provided with a joint, such as a finger joint 202, such that a plank of a desired length is provided, after which they can be used as construction material.

Such wood pieces or planks may be further formatted, such as planed on one or more sides thereof and/or profiled.

Areas of use for such wood pieces or planks include primarily structural members, such as joists, beams, studs or pillars.

Figure 2A:
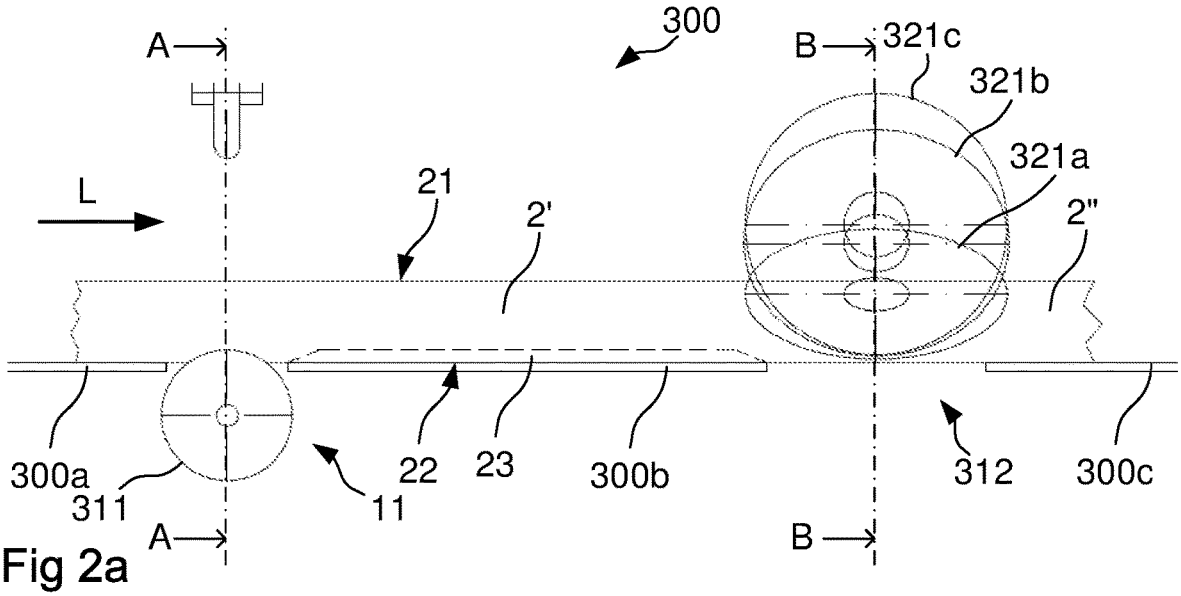
FIG. 2*a* is a schematic side view of a system for producing wood lamellae

FIG. 2*a* is a schematic side view of a device 300 for producing wood lamellae 20*a*, 20*b* from a half-log 2'. The device comprises a groove cutter 311 and a set 312 of radial cutters 321*a*, 321*b*, 321*c*, 321*d* and 321*e*. Moreover, the device 300 may comprise a conveyor arrangement 300*a*, 300*b*, 300*c* for causing relative movement between the log and the cutters 311, 312. Typically, the log may be moved relative to stationary cutters 311, 312. However, it is also possible to provide cutters 311, 312, which are capable of moving along the length of the half-log 2'.

The half log 2' has typically been longitudinally cut in half prior to being introduced into the device 300. That is, the log has been cut longitudinally along a plane containing a central axis C of the log. The log may have been pre-cut into an appropriate length, such as 1-10 m, preferably 1-5 m, 1-3 m or 1-2 m. Moreover, the log may have been wholly or partially debarked. Hence, the log can be said to present a planar surface 22 and a convex surface 21. For practical reasons, the log may be conveyed with its planar surface facing downwardly and oriented horizontally.

Figure 2B:
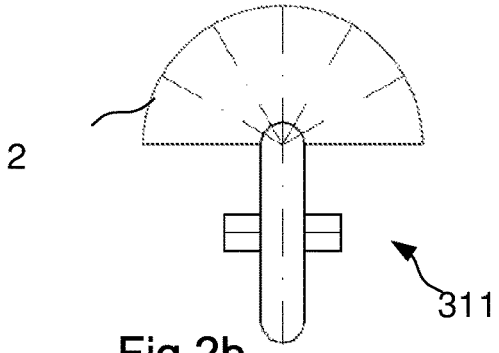
FIG. 2*b* is a schematic sectional view taken along line A-A of FIG. 2*a*.

FIG. 2*b* is a cross sectional view taken along line A-A in FIG. 2*a*. In FIG. 2*b*, it is illustrated how the groove cutter 311 provides a longitudinal groove at the central portion of the log, i.e. at the pith area.

The groove cutter 311 may be formed as a circular, rotatable cutter having a cutting edge with a cross section that corresponds to a desired cross section of the groove 23.

The groove 23 formed by the groove cutter 311 may presents a substantially concave surface, which may be substantially half circular, or which may be polygonal.

The groove cutter 311 may extend upwardly from a support on which the log is to be supported with its planar surface 22 facing downwardly.

Figure 3A:
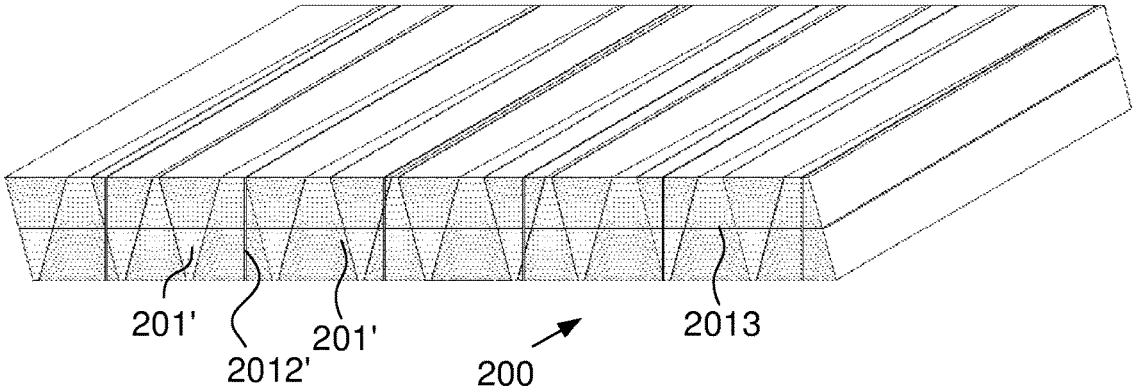
FIGS. 3*a*-3*c* schematically illustrate an alternative method of processing the intermediate wood product provided in FIG. 1*h*.
Figure 3B:
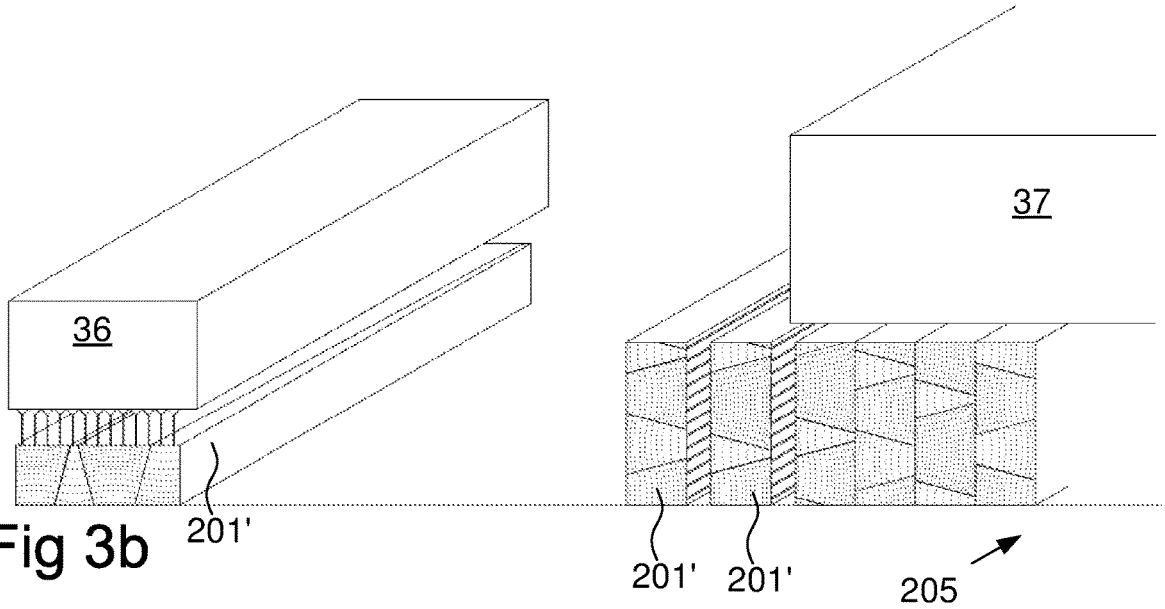
Figure 3C:
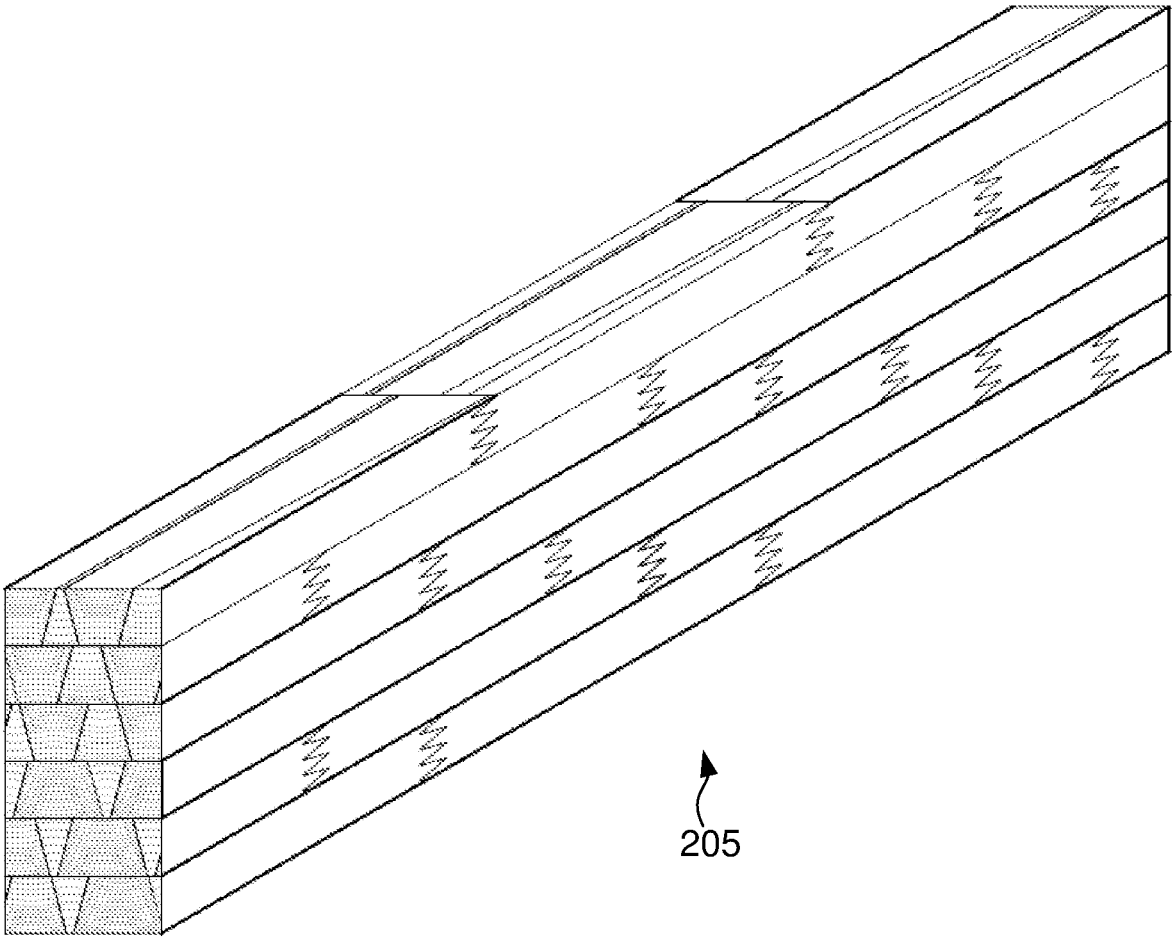

FIGS. 3*a*-3*c* schematically illustrate another way of processing the billet 200 formed at FIG. 1*g* and illustrated in FIG. 1*h*.

FIG. 3*a* illustrates a cutting scheme which differs from that disclosed with respect to FIG. 1*i*. Here the vertical cuts 2012', i.e. cuts extending substantially parallel with a principal fiber direction of the lamellae 20*a*, 20*b* and perpendicular to the base surfaces bs1, bs2 have a greater spacing, such that wider planks 201' are provided.

Moreover, there is illustrated a horizontal cut 2013, i.e. a cut extending substantially parallel with a principal fiber direction of the lamellae, but parallel with the base surfaces bs1, bs2.

Based on one or more horizontal cuts 2013, it is possible to divide the billet into two or more sheets, and/or it is possible to provide planks having smaller thickness. Each such plank 201' will then be formed of parts of two or more lamellae having trapezoidal cross section.

However, while the cutting illustrated in FIG. 1*i* provides wood pieces or wood planks 201 having a width corresponding to 1-2 major base surfaces bs1, the planks 201' provided in the sawing according to FIG. 3*b* may have a width of 2-6 major base surfaces bs1, preferably 2-4 major base surfaces bs1.

At this point, the planks 201' may be subjected to an accelerated drying process, such as kiln drying, as described with respect to FIG. 1*j*.

Before, or after the drying, planks 201' may be joined in an end-to-end manner, as described with respect to FIG. 1*k*, thus forming extended planks.

FIG. 3*b* schematically illustrates a process of gluing together such planks 201' and/or extended planks base surface to base surface by applying glue to the base surfaces. Such gluing may be a dry gluing.

In FIG. 3*b*, there is illustrated a glue applicator 36 which applies glue to the surface of the wood pieces 201' (and/or finger jointed beams/planks) that is formed by the base surfaces bs1, bs2. The wood pieces 201' are then glued together base surface bs1, bs2 to base surface bs1, bs2 as illustrated in FIG. 3*b*.

The wood pieces may be subjected to a pressing tool 37 pressing them together in directions parallel to the base surfaces and/or perpendicular to base surfaces and perpendicular to longitudinal axes C.

A predetermined number of wood pieces 201' or planks may be glued together in this manner to form e.g. a glulam beam 205.

FIG. 3*c* schematically illustrates such a glulam beam 205, which has been formed by the process described with respect to FIGS. 3*a*-3*c*. That is, the beam 205 is formed by a plurality of layers, which each comprise lamellae 20*a*, 20*b* having trapezoidal cross section, which are glued together side surface to side surface. The layers are glued together base surface to base surface. The layers may have substantially equal thickness, that is equal thickness +/− less than 10%, preferably +/− less than 5% or +/− less than 2%. Each layer may have a thickness which is 50% or less of a radius of a log from which the lamellae making up the layers were formed, possibly 40% or less or 30% or less.

Figure 4A:
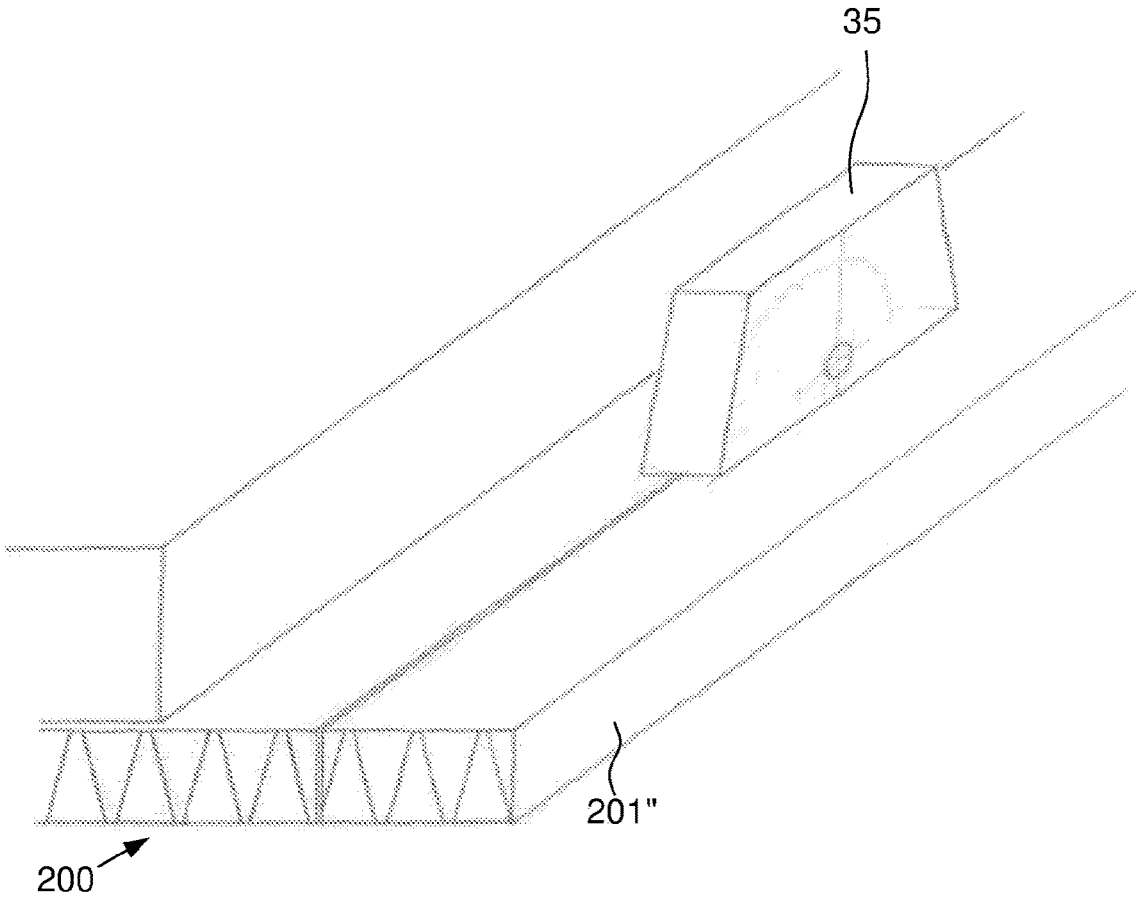
FIGS. 4*a*-4*c* schematically illustrate yet another alternative method of processing the intermediate wood product provided in FIG. 1*h*.
Figure 4B:
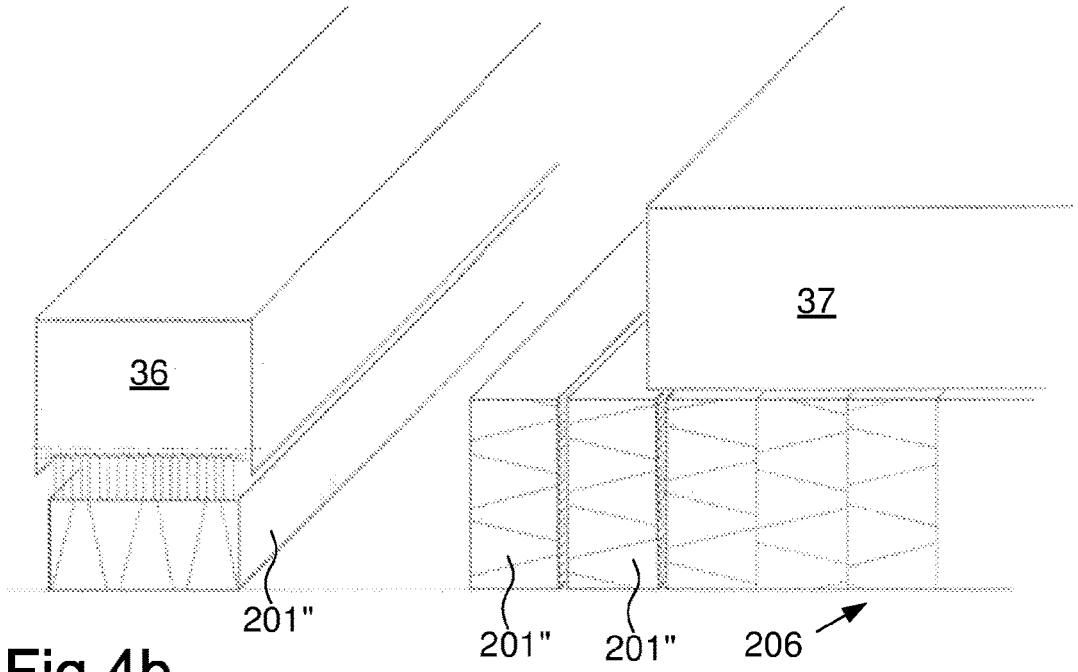
Figure 4C:
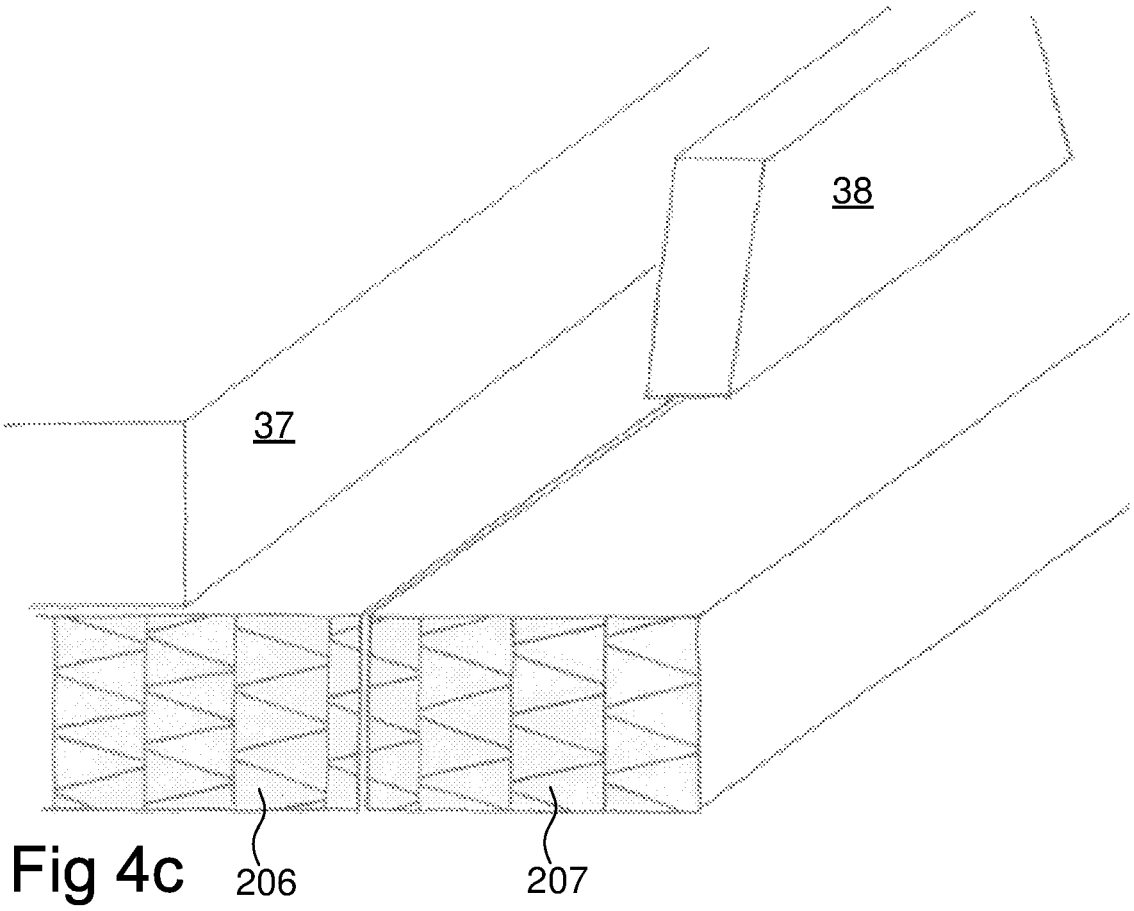

FIGS. 4*a*-4*c* schematically illustrate yet another way of processing the billet 200 formed at FIG. 1*g*. Here, just like in FIG. 1*i*, the billet 200 is cut along the length direction C, perpendicular to the base surfaces and along the principal fiber direction of the wood lamellae 20*a*, 20*b*, into a plurality of wood pieces 201", by a saw 35, as illustrated in FIG. 4*a*. The saw may be of the same type as the saw used for the cutting outlined with respect to FIG. 1*i*.

However, while the cutting illustrated in FIG. 1*i* provides wood pieces or wood planks 201 having a width corresponding to 1-2 major base surfaces bs1, the planks 201" provided in the sawing according to FIG. 4*b* may have a width of 2-6 major base surfaces bs1, preferably 2-4 major base surfaces bs1 and a thickness which is more than 50% of the radius of the log from which the lamellae were formed, preferably more than 75% of such radius, or even more than 90% of such radius.

After this cutting step, the thus produced wood pieces 201" may be subjected to accelerated drying, e.g. kiln drying, in the same manner as was described with respect to FIG. 1*j*.

After the drying step, it is possible to finger joint wood pieces 201" to form beams or planks of a desired length, as was described with reference to FIG. 1*k*.

Optionally, the planks 201" may be formatted, such as planed on one or more sides, before or after the finger jointing step.

In FIG. 4*b*, there is illustrated a glue applicator 36 which applies glue to the surface of the wood pieces 201" (and/or finger jointed beams/planks) that is formed by the base surfaces bs1, bs2. The wood pieces 201" are then glued together base surface bs1, bs2 to base surface bs1, bs2 as illustrated in FIG. 4*b*.

The wood pieces 201" are subjected to a pressing tool 37 pressing them together in directions parallel to the base surfaces and/or perpendicular to base surfaces and perpendicular to longitudinal axes C.

A predetermined number of wood pieces 201" or planks may be glued together in this manner to form e.g. a glulam billet 206.

The glulam billet 206 may be used as is, or, it may be cut into one or more beams 207 as illustrated in FIG. 4*c*. That is, the billet 206 comprising lamellae 20*a*, 20*b* having trapezoidal cross section, that are glued together both side surface to side surface and base surface to base surface, may be cut along plane that is parallel to the base surfaces and with the principal fiber direction of the wood lamellae 20*a*, 20*b*. Such a beam 207 may comprise at least two layers, preferably 2-5 layers, that have substantially the same thickness and one or two layers having a smaller thickness, e.g.

having a thickness which is 70% or less than the thickness of the other layers, or even 50% or less or 30% or less.

The invention claimed is:

1. A method of forming a laminated wood product, which is adapted for receiving a load in a direction perpendicular to a principal fiber direction of the wood, the method comprising:

cutting a log along the principal fiber direction of the log, into a plurality of wood lamellae, such that the wood lamellae are formed as radial sections of the log, forming the wood lamellae to provide each wood lamella with a trapezoidal cross section, whereby the wood lamellae present a respective planar major base surface that is formed at a radially outer part of the log and a respective planar minor base surface that is formed at a radially inner part of the log, and to provide each wood lamella with a taper in the principal fiber direction, arranging the lamellae as at least one layer in which planar major base surfaces of immediately adjacent lamellae face opposite directions, and gluing together the lamellae side surface to side surface such that a wood billet is formed, wherein the arranging step includes arranging the wood lamellae by turning every second lamella about 180° about an axis perpendicular to the principal fiber direction of the wood and perpendicular to the major base surface such that the major base surfaces of immediately adjacent wood lamellae taper in opposite directions, and wherein the gluing step comprises wet gluing at a moisture content of the wood lamellae greater than 25% by dry mass.

2. The method as claimed in claim 1, wherein the forming comprises a first forming step, in which the major base surfaces are formed along the outermost part of the log, along a direction which is substantially parallel with the outermost surface of the log.

3. The method as claimed in claim 1, wherein the minor base surfaces are formed along a direction which, as seen in a plane containing the pith, presents an angle relative to a pith direction, that is greater than an angle between the major base surface and the outermost surface of the log.

4. The method as claimed in claim 1, wherein the forming comprises a second forming step, in which the minor base surfaces are formed by removal of material at a portion of the respective lamella, which is close to the pith, and wherein more of a height of the trapezoidal cross section is removed when forming the minor base surface than when forming the major base surface.

5. The method as claimed in claim 1, wherein the wood lamellae are formed such that a distance, along a surface normal of the base surfaces, between the base surfaces, is at least 50% of a radius of the log.

6. The method as claimed in claim 1, wherein the cutting comprises cutting the wood lamellae to an apex angle of less than 45°.

7. The method as claimed in claim 1, further comprising a step wherein said wood lamellae are subjected to surface drying prior to gluing the wood lamellae together.

8. The method as claimed in claim 7, wherein the surface drying affects the moisture content of the wood lamellae by less than 5%.

9. The method as claimed in claim 1, wherein arranging the lamellae comprises arranging the lamellae as a single layer, with base surfaces exposed.

10. The method as claimed in claim 1, further comprising cutting the billet along a plane which is parallel to the principal fiber direction, and perpendicular to the base surfaces, thus forming a plurality of planks.

11. The method as claimed in claim 10, further comprising subjecting the planks to a drying step.

12. A method of forming a laminated wood product, which is adapted for receiving a load in a direction perpendicular to a principal fiber direction of the wood, the method comprising:

cutting a log along the principal fiber direction of the log, into a plurality of wood lamellae, such that the wood lamellae are formed as radial sections of the log, forming the wood lamellae to provide each wood lamella with a trapezoidal cross section, whereby the wood lamellae present a respective planar major base surface that is formed at a radially outer part of the log and a respective planar minor base surface that is formed at a radially inner part of the log, arranging the lamellae as at least one layer in which planar major base surfaces of immediately adjacent lamellae face opposite directions, and gluing together the lamellae side surface to side surface such that a wood billet is formed, wherein the arranging step includes arranging the wood lamellae such that the major base surfaces of immediately adjacent wood lamellae taper in opposite directions, wherein the gluing step comprises wet gluing at a moisture content of the wood lamellae greater than 25% by dry mass, cutting the billet along a plane which is parallel to the principal fiber direction, and perpendicular to the base surfaces, thus forming a plurality of planks, subjecting the planks to a drying step, and joining together at least two of the dried planks in an end-to-end manner, such that a longer plank is formed.

13. A method of forming a laminated wood product, which is adapted for receiving a load in a direction perpendicular to a principal fiber direction of the wood, the method comprising:

cutting a log along the principal fiber direction of the log, into a plurality of wood lamellae, such that the wood lamellae are formed as radial sections of the log, forming the wood lamellae to provide each wood lamella with a trapezoidal cross section, whereby the wood lamellae present a respective planar major base surface that is formed at a radially outer part of the log and a respective planar minor base surface that is formed at a radially inner part of the log, arranging the lamellae as at least one layer in which planar major base surfaces of immediately adjacent lamellae face opposite directions, and gluing together the lamellae side surface to side surface such that a wood billet is formed, wherein the arranging step includes arranging the wood lamellae such that the major base surfaces of immediately adjacent wood lamellae taper in opposite directions, wherein the gluing step comprises wet gluing at a moisture content of the wood lamellae greater than 25% by dry mass, cutting the billet along a plane which is parallel to the principal fiber direction, and perpendicular to the base surfaces, thus forming a plurality of planks, and laminating together at least two planks by gluing base surface to base surface.

14. The method as claimed in claim 1, wherein the gluing comprises wet gluing, i.e. gluing at a moisture content of the wood lamellae greater than 30% by dry mass.

15. The method as claimed in claim 1, wherein the wood lamellae are formed such that a distance, along a surface normal of the base surfaces, between the base surfaces, is at least 70% of the radius of the log.

16. The method as claimed in claim 1, wherein the cutting comprises cutting the wood lamellae to an apex angle of less than or equal to 36°.

17. The method as claimed in claim 7, wherein the surface drying affects the moisture content of the wood lamellae by less than 1%.

18. The method as claimed in claim 10, further comprising laminating together at least two joined-together planks by gluing base surface to base surface.

* * * * *